US009890560B2

(12) United States Patent
Wong et al.

(10) Patent No.: US 9,890,560 B2
(45) Date of Patent: Feb. 13, 2018

(54) LOCKING APPARATUS

(71) Applicant: Stephman Company Limited, Hong Kong (HK)

(72) Inventors: Ngai Kwong Wong, Hong Kong (HK); Joe Charnley, Essex (GB)

(73) Assignee: Stephman Company Limited, Hong Kong (HK)

( * ) Notice: Subject to any disclaimer, the term of this patent is extended or adjusted under 35 U.S.C. 154(b) by 0 days.

(21) Appl. No.: 15/646,113

(22) Filed: Jul. 11, 2017

(65) Prior Publication Data

US 2018/0016814 A1 Jan. 18, 2018

Related U.S. Application Data

(60) Provisional application No. 62/361,504, filed on Jul. 13, 2016, provisional application No. 62/419,448, filed on Nov. 8, 2016.

(51) Int. Cl.
*E05B 37/16* (2006.01)
*E05B 37/00* (2006.01)
*E05B 37/12* (2006.01)

(52) U.S. Cl.
CPC ..... *E05B 37/163* (2013.01); *E05B 37/0058* (2013.01); *E05B 37/12* (2013.01)

(58) Field of Classification Search
CPC ..... E05B 37/00; E05B 37/10; E05B 37/16; E05B 37/163; E05B 37/12; E05B 37/0008; E05B 37/0058
USPC ..... 70/213, 214, 297–299
See application file for complete search history.

(56) References Cited

U.S. PATENT DOCUMENTS 3,667,261 A * 6/1972 McGourty ..... E05B 37/166 70/214
4,627,250 A * 12/1986 Kim ..... E05B 37/16 70/214
4,671,084 A * 6/1987 Lin ..... E05B 37/16 70/25
6,026,665 A * 2/2000 Raybary ..... E05B 37/163 70/214
6,298,698 B1 * 10/2001 Nakajima ..... E05B 37/16 70/214
6,334,346 B1 * 1/2002 Wang ..... E05B 37/16 70/214
6,575,004 B2 * 6/2003 Berton ..... E05B 37/163 70/214
6,755,059 B1 * 6/2004 Nall ..... E05B 37/166 292/DIG. 37

(Continued)

*Primary Examiner* — Suzanne Barrett

(57) ABSTRACT

A locking apparatus includes an actuating hub rotatably mounted on a base, a handle connected with the actuating hub, a control plate provided adjacent to the actuating hub and formed with a plurality of teeth, two locking tumblers, and a series of button engagement disc clutch plates and coding disc clutch plates mounted on the locking tumblers, whereby pressing a selected group of buttons rotates their respective button engagement disc clutch plates and coding disc clutch plates such that cut-out apertures formed on the coding disc clutch plates align with the teeth of the control plate, thereby allowing movement of the control plate and rotation of the actuating hub when the grip handle is rotated. The apparatus also includes a code change button and a reset button.

14 Claims, 15 Drawing Sheets

(56) References Cited

U.S. PATENT DOCUMENTS

| | | | | |
|---|---|---|---|---|
| 7,437,899 | B1 * | 10/2008 | Ma | E05B 37/0034 292/36 |
| 8,215,141 | B2 * | 7/2012 | Yi | E05B 37/16 70/21 |
| 8,375,751 | B2 * | 2/2013 | Hacker | E05B 19/0005 292/DIG. 27 |
| 8,555,686 | B2 * | 10/2013 | Meekma | E05B 37/0068 70/288 |
| 8,683,832 | B2 * | 4/2014 | Watanabe | E05B 37/16 70/214 |
| 8,973,418 | B2 * | 3/2015 | Graham | E05B 37/163 70/288 |
| 9,175,504 | B2 * | 11/2015 | Wong | E05B 37/0058 |
| 2001/0045112 | A1 * | 11/2001 | Berton | E05B 37/163 70/214 |
| 2003/0126896 | A1 * | 7/2003 | Mori | E05B 37/16 70/214 |
| 2004/0261477 | A1 * | 12/2004 | Wang | E05B 37/166 70/214 |
| 2005/0086982 | A1 * | 4/2005 | Nakazima | E05B 37/16 70/214 |
| 2007/0144226 | A1 * | 6/2007 | Miao | E05B 37/16 70/214 |
| 2008/0115546 | A1 * | 5/2008 | Hu | E05B 13/004 70/214 |
| 2008/0216531 | A1 * | 9/2008 | Waller | E05B 37/16 70/298 |
| 2015/0000355 | A1 * | 1/2015 | Wong | E05B 37/0058 70/291 |

* cited by examiner

LOCKING APPARATUS

CROSS-REFERENCE TO RELATED APPLICATIONS

This application claims the benefit of U.S. Provisional Patent Application No. 62/361,504, filed on Jul. 13, 2016 and U.S. Provisional Patent Application No. 62/419,448, filed on Nov. 8, 2016, the entire contents of which are hereby incorporated by reference.

TECHNICAL FIELD

The present application relates to locking apparatus, particularly, but not exclusively, locking apparatus for use on a mechanical combination door lock.

BACKGROUND

It is desirable in many circumstances to allow building entry doors, windows, cupboards etc. to be opened only by those who have been authorised to do so. One way of achieving this is to use a mechanical locking mechanism which requires a predetermined code to be entered before it can be unlocked and mechanical combination door locks are widely used for this purpose.

Such locks are typically provided with a series of alphanumeric buttons (often 4, 6, 8, 10 or 12 buttons) and a knob or handle which can be grasped by the user. In operation, an authorised user dials the correct passcode into the mechanism, then turns the knob or handle in order to unlock the mechanism. The passcode on such locks can typically be changed to suit a user's preference by dismantling a portion of the lock (normally from the rear) and switching the orientation of certain locking pins provided in the body of the lock; however, for security reasons this normally requires that the lock is first opened to gain access to the rear/inside of the door before then removing the lock from its mount on the door. This can be relatively time consuming, is often inconvenient, and requires a degree of skill and care in order to correctly change the code and to correctly re-mount the lock back on the door.

SUMMARY

According to one aspect, there is provided a locking apparatus which may include:

- a cover plate coupled with a base;
- a plurality of buttons provided on a cover plate;
- an actuating hub rotatably mounted on the base, a circumference of the actuating hub formed with a recessed portion defining two projections;
- a grip handle connected with the actuating hub;
- a first control plate disposed adjacent to the actuating hub and having one end formed with a raised portion, the two projections of the actuating hub being abutted against two sides of the raised portion of the first control plate respectively, such that when the actuating hub rotates clockwise or anticlockwise, one of the two projections presses against a corresponding one of the two sides of the raised portion of the first control plate, the first control plate further including two longitudinal side plates, and a plurality of teeth projecting inwardly from each of the two longitudinal side plates;
- first and second parallel locking tumblers, each having a central axle mounted on the base;

- a series of button engagement disc clutch plates mounted on the central axle of each locking tumbler, each button engagement disc clutch plate including a pair of button pin engagement levers for engagement therein between with a protruded portion of a button pin of the button; and
- a series of coding disc clutch plates mounted on the central axle of each locking tumbler, and engaging respectively with the series of button engagement disc clutch plates, each coding disc clutch plate including a cut-out aperture;
- whereby pressing a selected group of the buttons, which correspond to an access code, rotates their respective button engagement disc clutch plates and in turn their respective coding disc clutch plates such that the cut-out apertures align with the teeth of the first control plate, thereby allowing movement of the first control plate and rotation of the actuating hub when the grip handle is rotated.

According to another aspect, there is provided a locking apparatus which may include:

- a plurality of buttons provided on a cover plate which is coupled with a base;
- an actuating hub rotatably mounted on the base, a circumference of the actuating hub formed with a recessed portion defining two projections;
- a grip handle connected with the actuating hub;
- a first control plate disposed adjacent to the actuating hub and having one end formed with a raised portion, the two projections of the actuating hub being abutted against two sides of the raised portion of the first control plate respectively, such that when the actuating hub rotates clockwise or anticlockwise, one of the two projections presses against a corresponding one of the two sides of the raised portion of the first control plate, the first control plate further including two longitudinal side plates, and a plurality of teeth projecting inwardly from at least one of the two longitudinal side plates;
- at least one locking tumbler, the or each locking tumbler having a central axle mounted on the base;
- a series of button engagement disc clutch plates mounted on the central axle of the or each locking tumbler, each button engagement disc clutch plate including a pair of button pin engagement levers for engagement therein between with a protruded portion of a button pin of the button; and
- a series of coding disc clutch plates mounted on the central axle of the or each locking tumbler, and engaging respectively with the series of button engagement disc clutch plates, each coding disc clutch plate including a cut-out aperture;
- whereby pressing a selected group of the buttons, which correspond to an access code, rotates their respective button engagement disc clutch plates and in turn their respective coding disc clutch plates such that the cut-out apertures align with the teeth of the first control plate, thereby allowing movement of the first control plate and rotation of the actuating hub when the grip handle is rotated.

In one embodiment, the locking apparatus may include a pair of parallel locking tumblers, and the plurality of teeth may project inwardly from each of the two longitudinal side plates of the first control plate.

In one embodiment, the locking apparatus may further include a code change button, and an angled slide provided underneath the code change button, the angled slide being formed with a slanted surface which engages with an inner edge of a second control plate.

In one embodiment, wherein the second control plate may include a series of tabs engaging respectively with the series of coding disc clutch plates on the central axle of each locking tumbler; whereby when the code change button is pressed after the selected group of the buttons have been pressed, the angled slide urges the second control plate to make a translational movement relative to the base, resulting in that the series of coding disc clutch plates dislocate from the series of button engagement disc clutch plates by the series of tabs, thereby allowing a user to change the access code by selecting and pressing another group of the buttons, and changing angular orientation of the button engagement disc clutch plates relative to their corresponding coding disc clutch plates.

In one embodiment, each button engagement disc clutch plate may include three recessed portions formed along a peripheral portion thereof, and each coding disc clutch plate may include two projected portions formed along a peripheral portion thereof; wherein when the two projected portions are engaged with two of the three recessed portions, the cut-out aperture of the coding disc clutch plate is aligned with the teeth of the first control plate, and when the two projected portions are engaged with another two of the three recessed portions, the cut-out aperture of the coding disc clutch plate is out of alignment with the teeth of the first control plate.

In one embodiment, a primary spring and a secondary spring are provided around the button pin of each button to resiliently return the button to its original position after having been pressed and released by the user.

In one embodiment, a tertiary spring is provided between adjacent sets of engaging button engagement disc clutch plate and coding disc clutch plate on each central axle for biasing each coding disc clutch plate against its engaging button engagement disc clutch plate.

In one embodiment, a pair of quaternary springs is provided on the first control plate for biasing the first control plate towards the actuating hub.

In one embodiment, the base is provided with a locking block including a block body with an enlarged head, the block body being inserted into a bore formed at the base, such that an inner end of the block body abuts against an inner end of the angled slide of the code change button, and an outer end of the block body is provided with the enlarged head located on an outer surface of the base; wherein the locking block is held in place within the bore when the base of the locking apparatus is held against and secured on a panel, and the locking block drops out of the bore after the locking apparatus is detached from the panel, and the inner end of the angled slide is inserted into the bore through an opening by pressing the code change button.

In one embodiment, the locking apparatus may further include a reset button; a reset slide provided underneath the reset button; a coding bar mounted on the base between the first and second locking tumblers and formed with a sloped surface facing the reset slide; and a quinary spring mounted between one end of the coding bar and the base for biasing the coding bar in one direction; wherein when the selected group of the buttons are pressed, their respective coding disc clutch plates rotate and engage with the coding bar, and when the reset button is pressed, the reset slide presses on the sloped surface and urges the coding bar to move in an opposite direction against biasing force of the quinary spring, thereby releasing the coding disc clutch plates to their initial positions, and when the reset button is released, the coding bar returns to its initial position.

In one embodiment, the protruded portion of each button pin protrudes perpendicularly from the button pin of the button, and the pair of button pin engagement levers projects in a direction radially outwardly from the central axle.

In one embodiment, the selected group of the buttons may include one or more of the buttons provided on the cover plate.

Further features and advantages of the aspects of the present application will become apparent from the following description.

BRIEF DESCRIPTION OF THE DRAWINGS

Embodiments of the present application will now be described by way of example only, with reference to the following diagrams, in which.

DETAILED DESCRIPTION

Reference will now be made in detail to a preferred embodiment of the locking apparatus, examples of which are also provided in the following description. Exemplary embodiments of the locking apparatus are described in detail, although it will be apparent to those skilled in the relevant art that some features that are not particularly important to an understanding of the locking apparatus may not be shown for the sake of clarity.

Furthermore, it should be understood that the locking apparatus is not limited to the precise embodiments described below and that various changes and modifications thereof may be effected by one skilled in the art without departing from the scope of the protection. For example, elements and/or features of different illustrative embodiments may be combined with each other and/or substituted for each other within the scope of this disclosure and appended claims.

Figure 1:
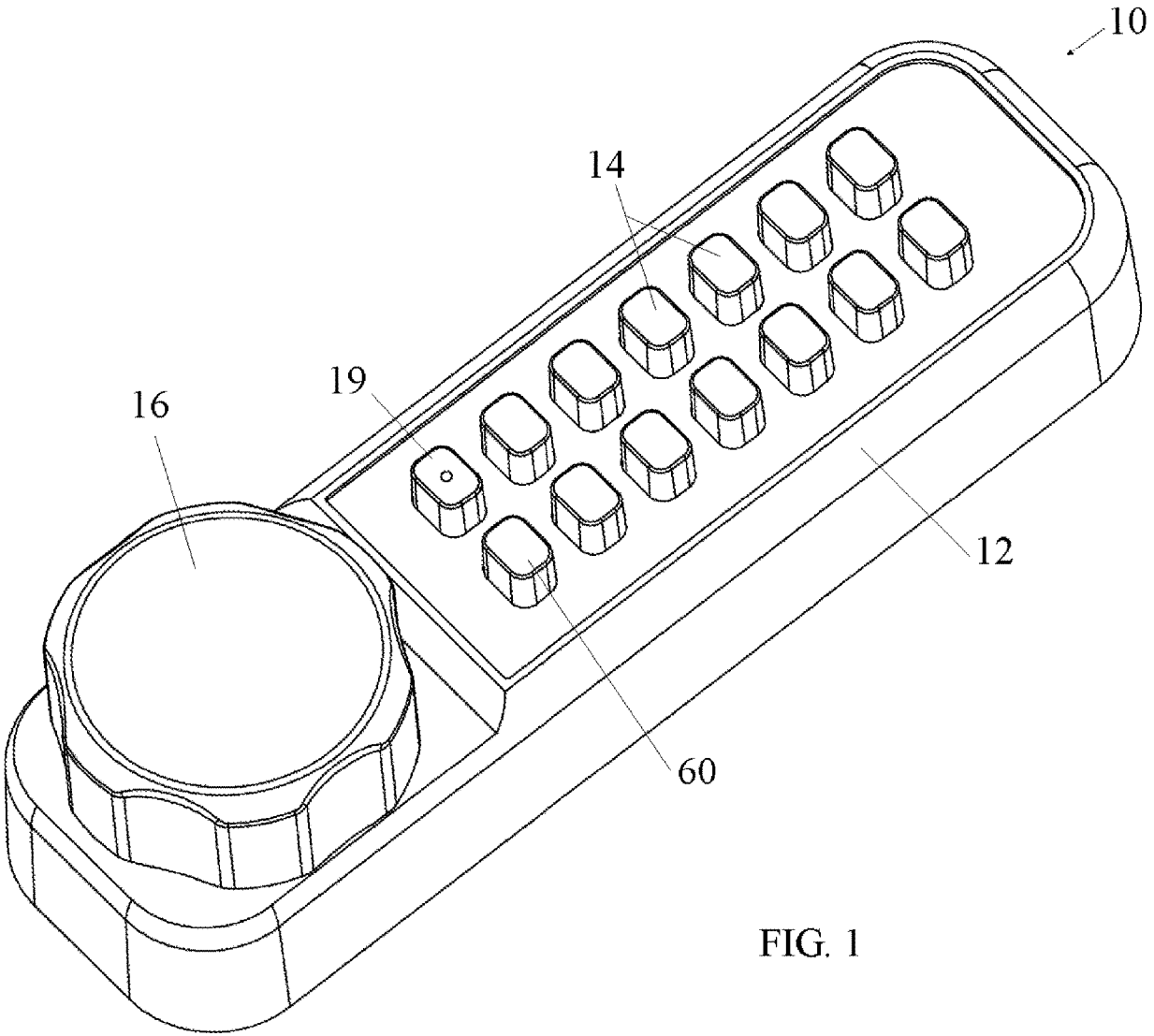
FIG. 1 is a schematic perspective illustration of an assembled locking apparatus according to an embodiment of the present application.

As shown in FIG. 1, the locking apparatus 10 of the present application may include a strong and durable cover plate 12, a plurality of key press buttons 14, and an opening/closing knob or grip handle 16. The key press buttons 14 may be provided with a number of letters/numerals (not shown) such that, once a user has keyed in the correct code, the user is then able to rotate the grip handle 16 in order to unlock the lock and gain access to the otherwise secured area.

At least one of the key press buttons may be designated as a code change button 19. In the present embodiment, this is shown as the bottom button in the first column of buttons; however, this could be provided on any one (or many) of the buttons 14.

Figure 1A:
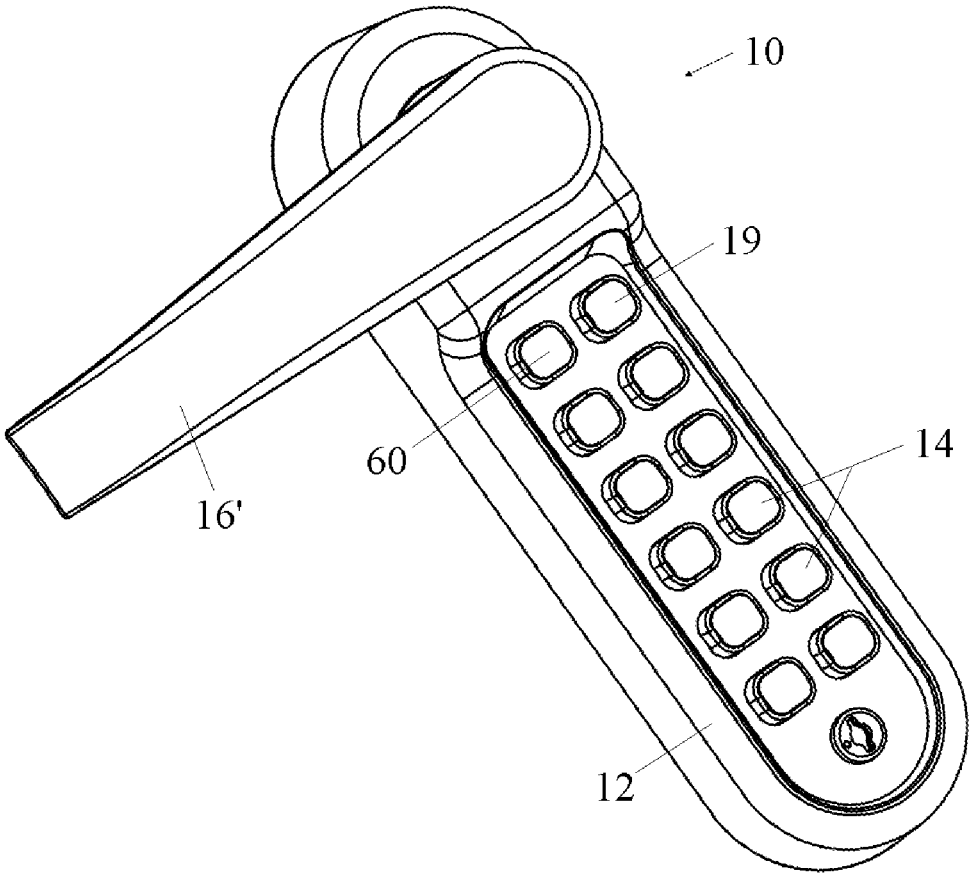
FIG. 1*a* is a schematic perspective illustration of an assembled locking apparatus according to another embodiment of the present application.

FIG. 1*a* shows another embodiment of the grip handle 16' of the locking apparatus 10.

Figure 2:
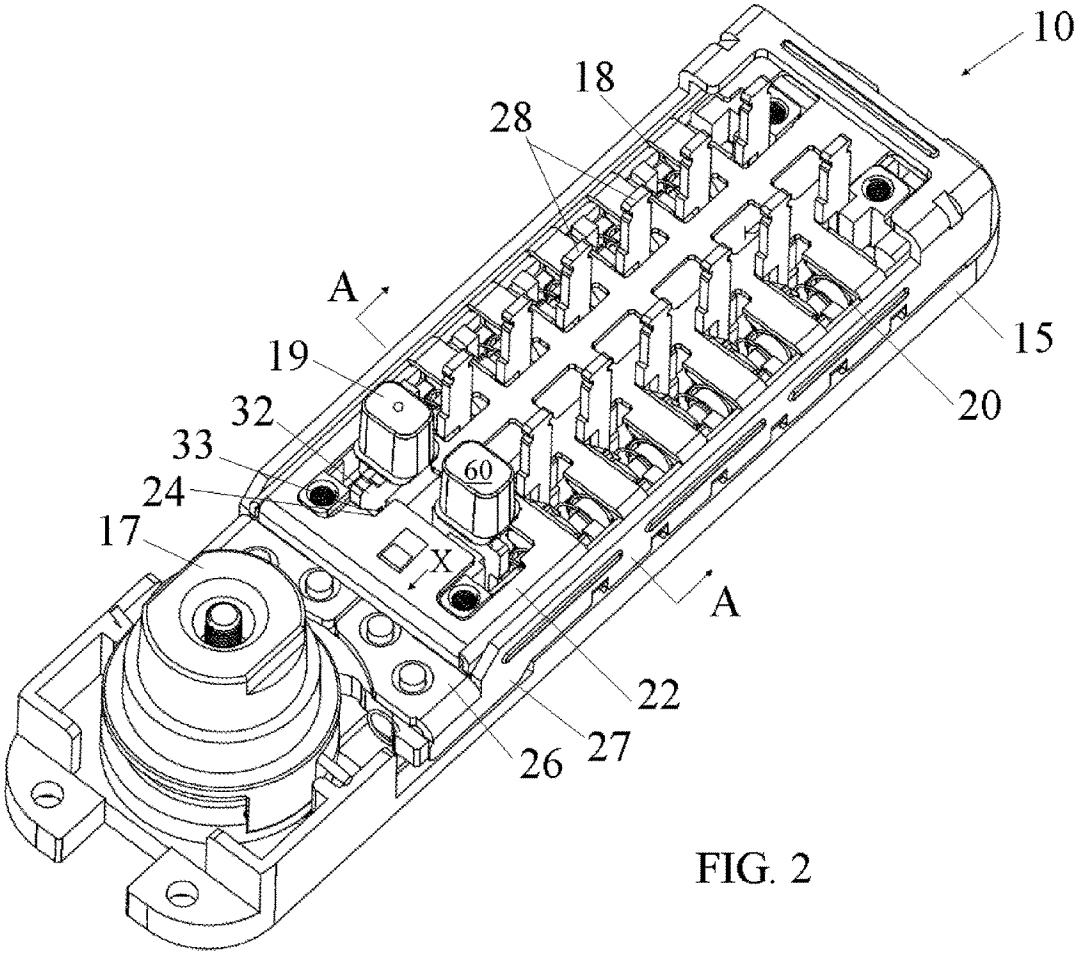
FIG. 2 is a schematic perspective illustration of an embodiment of the locking apparatus where a protective cover has been removed for illustrative purposes.

With particular reference to FIG. 2, beneath the cover 12, the locking apparatus 10 may be provided with a base 15 upon which may be mounted an inner actuating hub 17, first and second parallel code operated locking tumblers 18, 20, a first control plate 26, a second control plate 22 and a series of button pins 28 which connect at their upper end to the buttons 14 and at their lower/intermediate ends to the locking tumblers 18, 20 as will be described subsequently.

The base 15 allows the locking apparatus 10 to be securely attached to the surface of a door or other such arrangement and provides a secure base upon which the other components of the apparatus are mounted.

Figure 3:
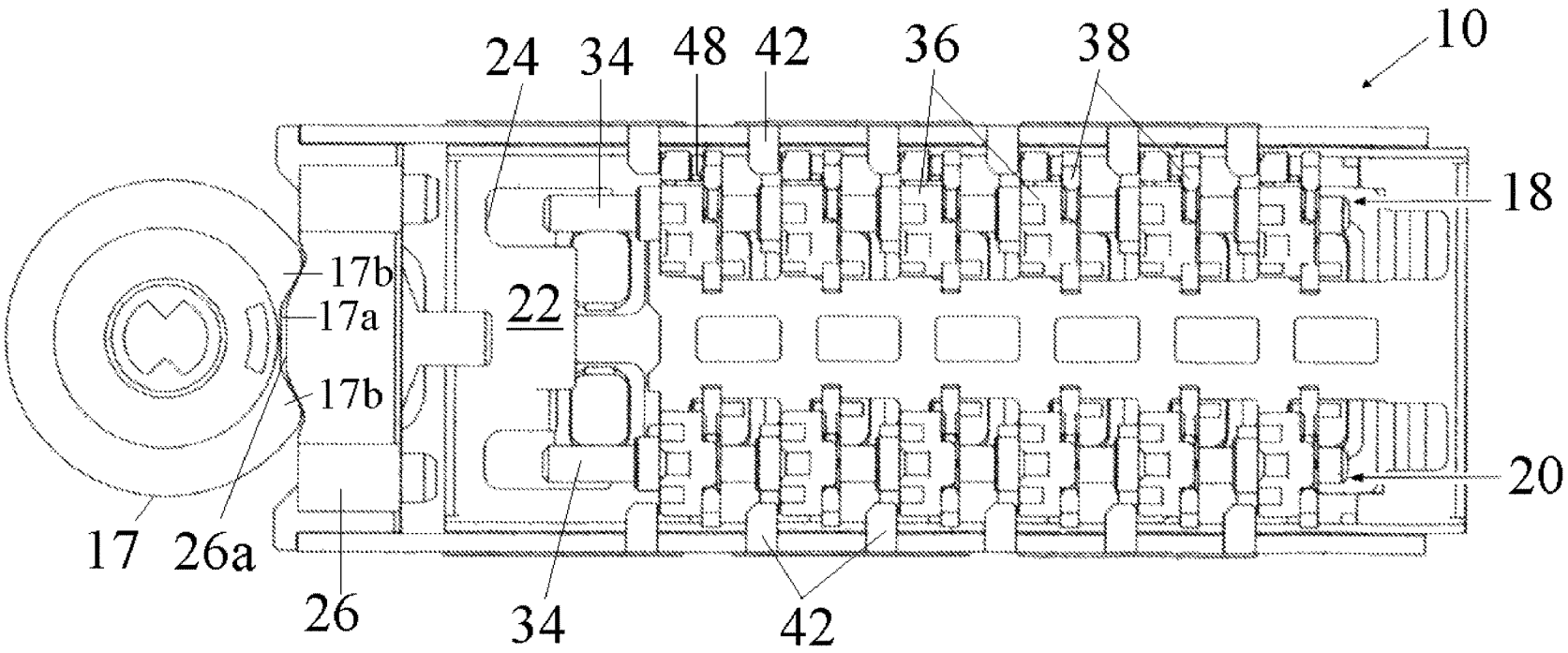
FIG. 3 is a schematic bottom plan view illustration of the locking apparatus in a normal locking/unlocking mode where coding tumbler clutch plates and button engagement clutch plates are located in abutment with one another.
Figure 3B:
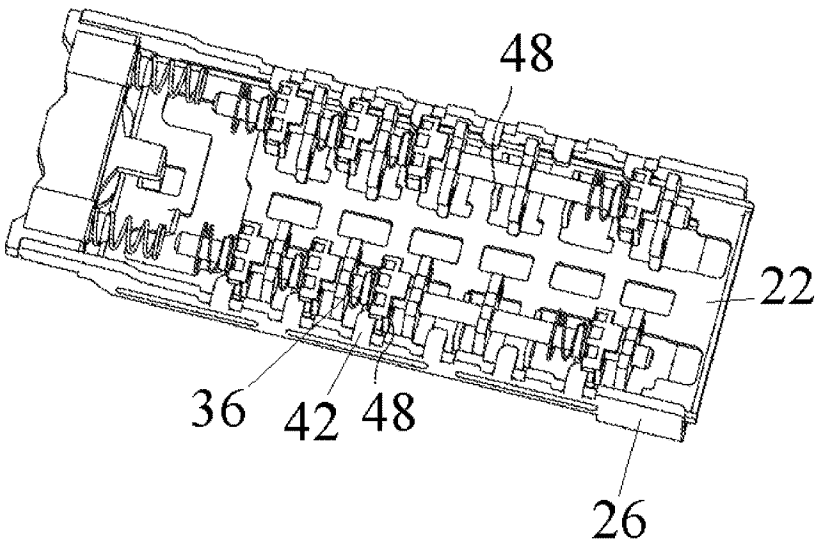
FIGS. 3*a* and 3*b* are schematic perspective illustrations of the locking apparatus in a code unchangeable condition and a code changeable condition respectively.
Figure 3A:
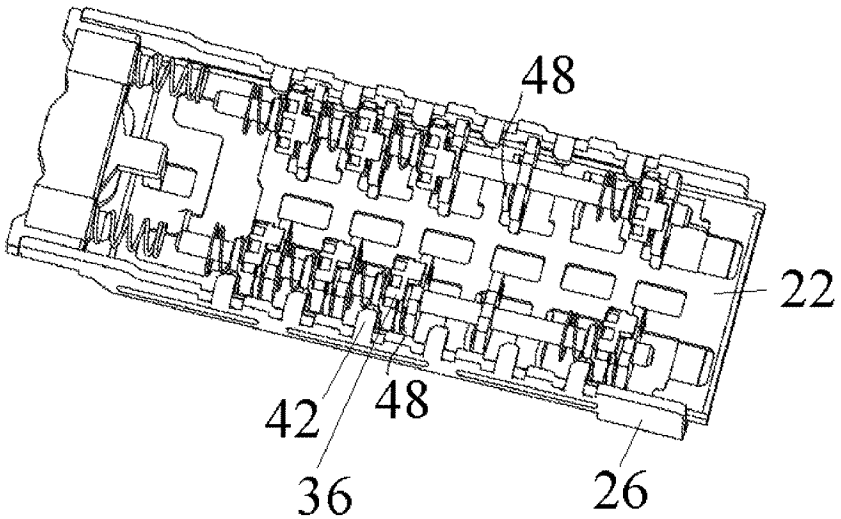

The inner actuating hub 17 may be directly connected to the outer grip handle 16. Referring to FIG. 3, a circumference of the actuating hub 17 may be formed with a recessed portion 17*a* which defines two projections 17*b* abutting against two sides of a raised portion 26*a* formed at one end of the first control plate 26 respectively such that when the actuating hub 17 rotates clockwise or anticlockwise, one of the two projections 17*b* presses against a corresponding one of the two sides of the raised portion 26*a* of the first control plate 26 (and move it if the apparatus is unlocked yet be prevented from such movement if the apparatus is locked as described subsequently).

An angled slide 32 may be provided beneath the code change button 19. The angled slide 32 may be formed with a slanted surface 33, as shown in FIG. 2, which can engage with an inner edge 24 of the second control plate 22 in a sliding fashion, whereby downward movement of the angled slide 32 results in a corresponding translational movement of the second control plate 22 in the direction indicated by arrow X in FIG. 2.

As shown in FIG. 2, the first control plate 26 can be a longitudinal structure having two longitudinal side plates 27. A series of teeth 42 may extend inwardly from each of the two longitudinal side plates 27. The first control plate 26, the two side plates 27 and the teeth 42 may be integrally formed as one piece. The first control plate 26 and the second control plate 22 may move independently in a longitudinal direction.

Figure 5:
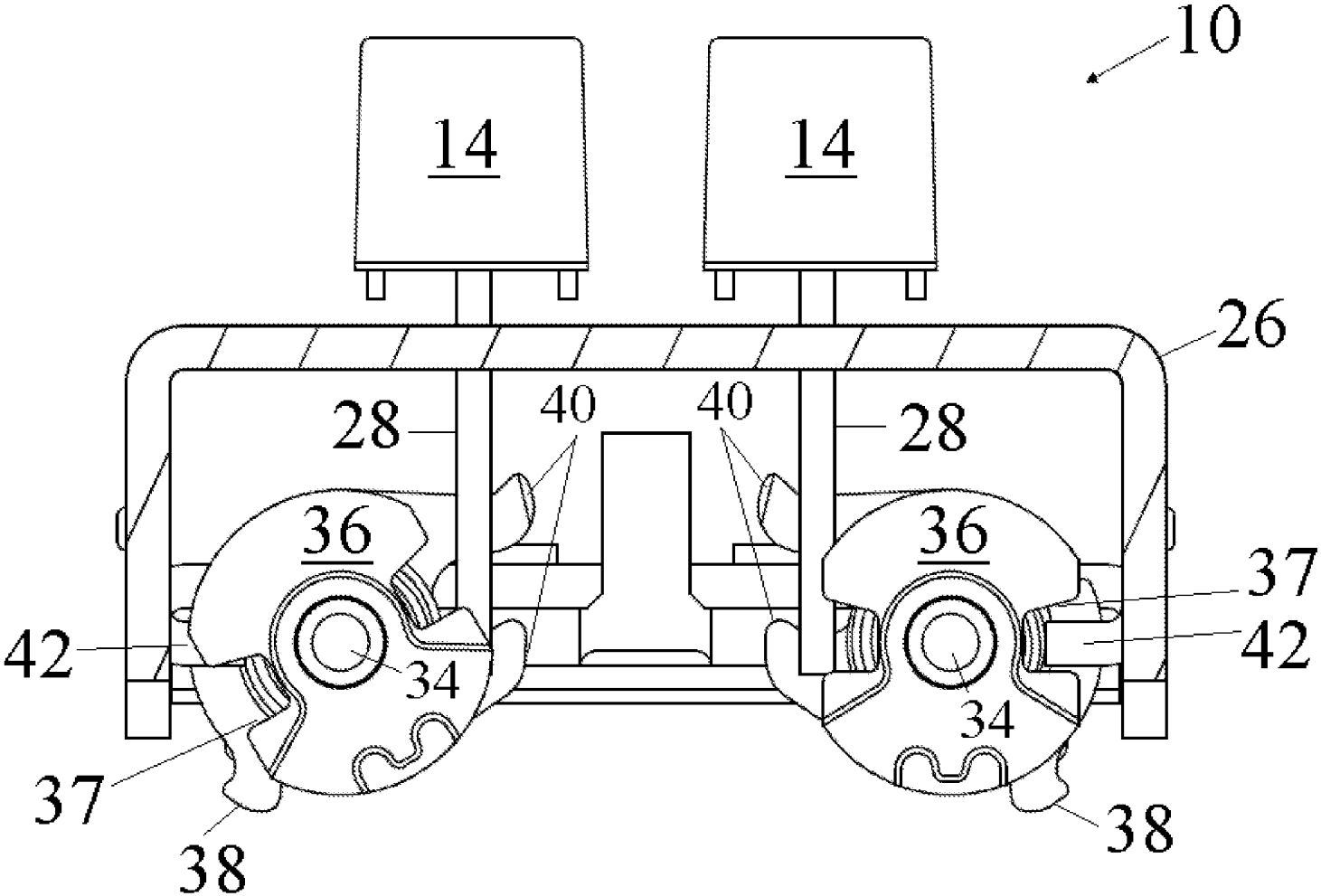
FIG. 5 is a partial cross sectional illustration of coding tumbler clutch plates and button engagement clutch plates viewed in the direction indicated as A-A in FIG. 2 and prior to entry of an unlock code where a coding tumbler clutch plate is blocking movement of a locking tooth of a lock control plate.

With reference to FIG. 3, the locking tumblers 18, 20 each comprise a central axle 34 mounted to the base 15 and upon which are mounted a series of coding disc clutch plates 36 and a series of corresponding button engagement disc clutch plates 38. As best illustrated in FIG. 5, each coding disc clutch plate 36 comprises at least one cut-out aperture 37, and each button engagement disc clutch plate 38 comprises a pair of button pin engagement levers 40 which may project in a direction radially outwardly from the central axle 34. A protruded portion 29 (FIGS. 6*a*-6*b*) may protrude perpendicularly from the button pin 28 and can be positioned between the pair of button pin engagement levers 40.

Although it has been shown and described that there are two locking tumblers, it is understood by one skilled in the art that the locking apparatus of the present application may have only one locking tumbler, and the plurality of teeth may be formed only on one longitudinal side plate of the control plate.

The relative angular position of each coding disc clutch plate 36 relative to each button engagement disc clutch plate 38 is what determines whether the teeth 42 of the first control plate 26 are able to translate along the length of the apparatus or not since, in certain angular positions (such as that shown at the left side of FIG. 5), the coding disc clutch plate 36 will block such movement of the teeth 42; whereas, in other positions (such as that shown at the right side of FIG. 5), the aperture 37 in the coding disc clutch plate 36 will align with the teeth 42 in order to allow such translating movement.

Figure 8:
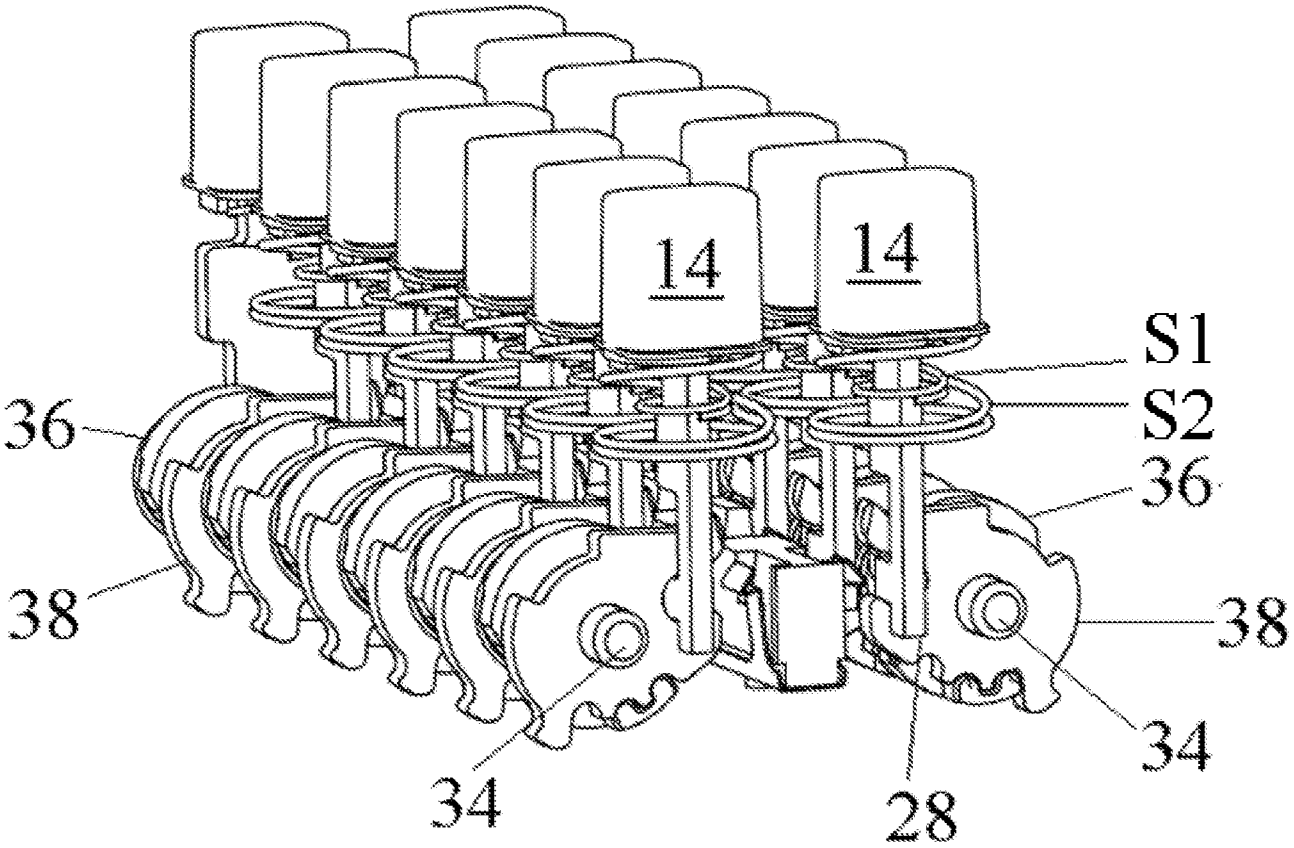
FIG. 8 is an upper schematic perspective illustration of first and second coding tumblers and their respective buttons in isolation from the apparatus.

With reference to FIG. 8, primary springs S1 and secondary springs S2 may be provided around the button pins 28 in order to resiliently return the buttons 14 to their original position after having been pressed and released by a user.

The locking and unlocking function of the locking apparatus will now be described.

In use, prior to a user entering the correct access code, if the user attempts to rotate the grip handle 16 (and hence the underlying actuating hub 17) one of the two projections 17*b* (depending upon which direction the user turns the grip handle 16) will press against a corresponding one of the two sides of the raised portion 26*a* of the first control plate 26. However, the first control plate 26 cannot move due to at least one of its teeth 42 being prevented from translating along the length of the apparatus by at least one of the coding disc clutch plates 36 as previously described. This therefore prevents the handle 16 from being rotated and hence prevents the lock from being opened.

With reference to FIG. 1, the code change button 19 cannot be depressed prior to entry of the correct access code since downward movement of the button is prevented by the engagement between the angled slide 32 and the inner edge 24 of the second control plate 22 (which itself cannot move until the correct access code has been entered.

One or more buttons might be included in the correct access code, e.g. the code might be "1234". Upon pressing a selected group of the buttons 14, which correspond to the access code, each button pin 28 rotates the aperture 37 of each of the four coded clutch plates 36 such that the apertures 37 align with the teeth 42. Once this condition has been achieved for each coded clutch plate, if the user then rotates the grip handle 16, one of the two projections 17*b* will press against a corresponding one of the two sides of the raised portion 26*a* and therefore will be able to move the first control plate 26 because the teeth 42 are no longer blocked by the coding discs clutch plates 36. This allows a locking bolt of the door to be opened. In this way it can be understood that the angular orientation of each coding disc clutch plate 36 relative to its respective button engagement disc clutch plate 38 is what determines whether the lock can be opened or not.

When a user wishes to change the access code on the locking apparatus to a different code of their choosing, they must first enter the correct existing access code to do so. If they do not first enter the correct existing access code they cannot depress the code change button 19 (due to the second control plate 22 not being able to translate) and hence will be unable to change the code of the locking apparatus.

With the correct access code entered, the user is able to depress the code change button 19. Doing so forces the angled slide 32 down against the inner edge 24 of the second control plate 22. This co-operation between the angled slide 32 and the inner edge 24 in turn translates each of the coding disc clutch plates 36 from the position shown in FIG. 3 to the position shown in FIG. 4 such that the coding disc clutch plates 36 are effectively dislocated from the button engagement disc clutch plates 38 by means of a series of corresponding tabs 48, as illustrated in FIGS. 3*a*-3*d*, formed on the second control plate 22 and engaging with the series of coding disc clutch plates 36 respectively. The user then selects a new code by pressing whichever buttons 14 they desire (e.g. 5678) in order to change the angular orientation of certain button engagement disc clutch plates 38 relative to their corresponding coding disc clutch plates 36.

FIGS. 6*a*-6*d* and FIGS. 7*a*-7*d* show the difference in angular orientation present in the coding disc clutch plates 36 and the button engagement disc clutch plates 38. In the present embodiment, each button engagement disc clutch plate 38 may include three recessed portions 35 formed along a peripheral portion thereof, and each coding disc clutch plate 36 may include two projected portions 39 formed along a peripheral portion thereof.

Figure 6:
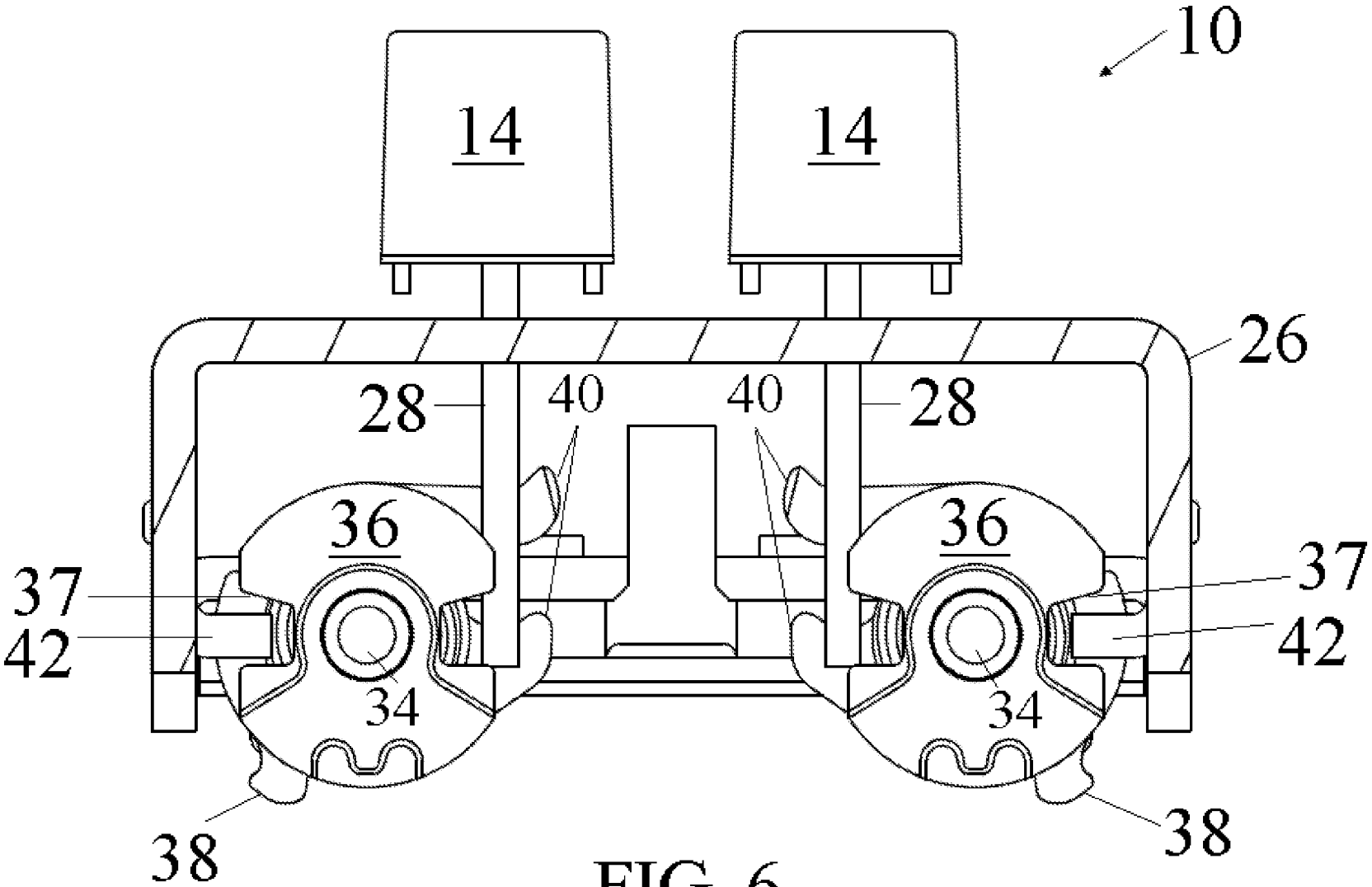
FIG. 6 is a partial cross sectional illustration of coding tumbler clutch plates and button engagement clutch plates viewed in the direction indicated as A-A in FIG. 2 and after entry of an unlock code where the coding tumbler clutch plate allows a locking tooth of the lock control plate to pass through an aperture provided at one side thereof.
Figure 6D:
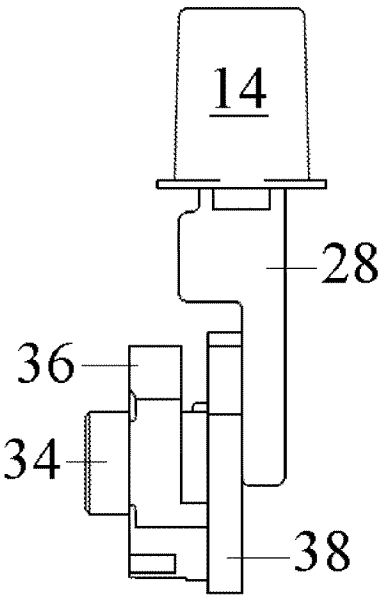
FIGS. 6*a*-6*d* are respective front, left, rear and right side illustrations of a single coding tumbler clutch plate and a corresponding single button engagement clutch plate positioned in a first angular orientation relative to one another prior to a user conducting a code change operation.
Figure 6C:
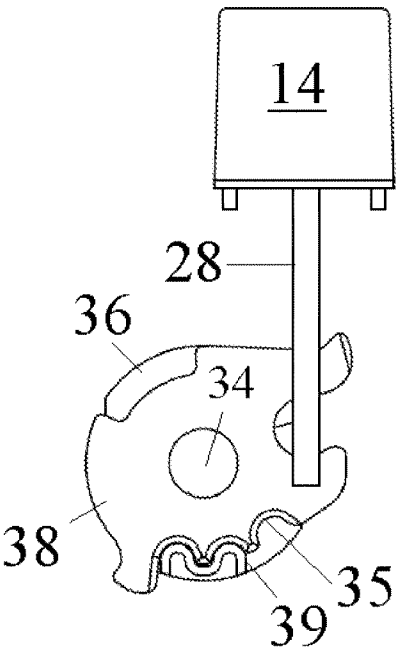
Figure 6B:
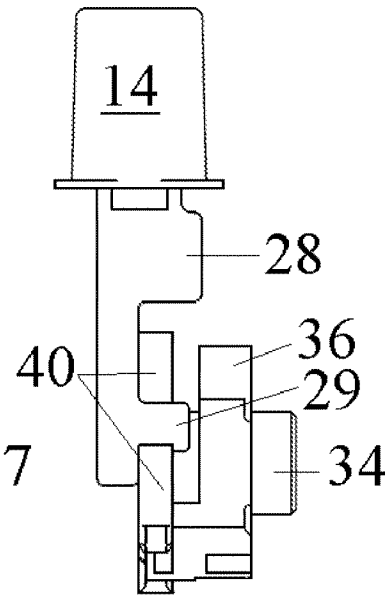
Figure 6A:
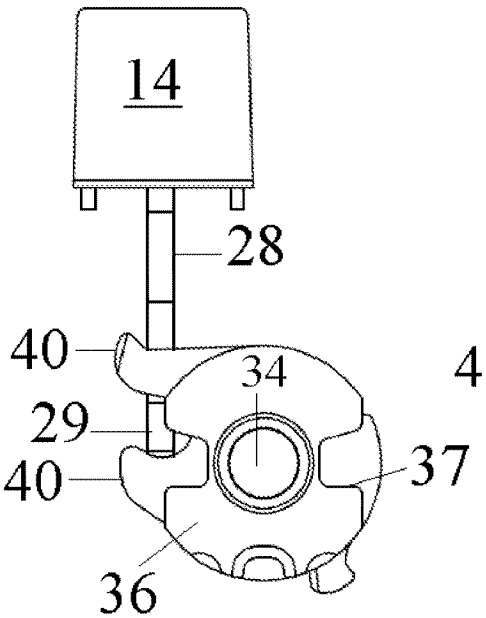
Figure 7D:
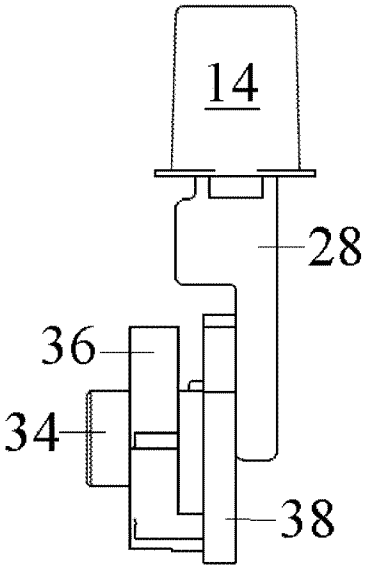
FIGS. 7*a*-7*d* are respective front, left, rear and right side illustrations of a single coding tumbler clutch plate and a corresponding single button engagement clutch plate positioned in a second angular orientation relative to one another following a user having conducted a code change operation.
Figure 7C:
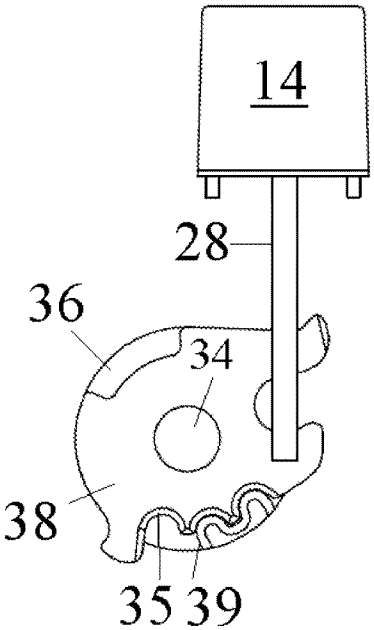
Figure 7B:
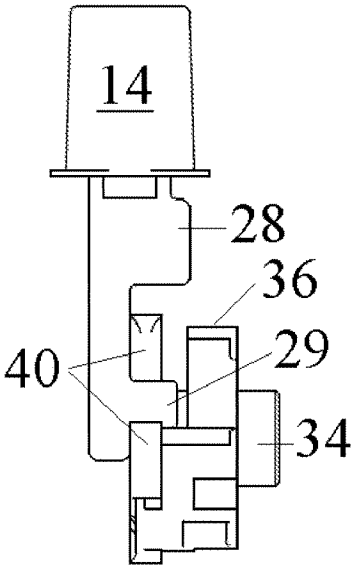
Figure 7A:
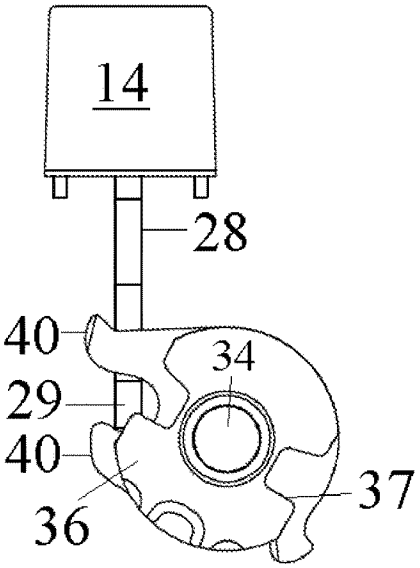

When the two projected portions 39 are engaged with two of the three recessed portions 35, as shown in FIG. 6*c*, the cut-out aperture 37 of the coding disc clutch plate 36 is aligned with the teeth 42 of the first control plate 26. When the two projected portions 39 are engaged with another two of the three recessed portions 35, as illustrated in FIG. 7*c*, the cut-out aperture 37 of the coding disc clutch plate 36 is out of alignment with the teeth 42 of the first control plate 26.

Figure 3D:
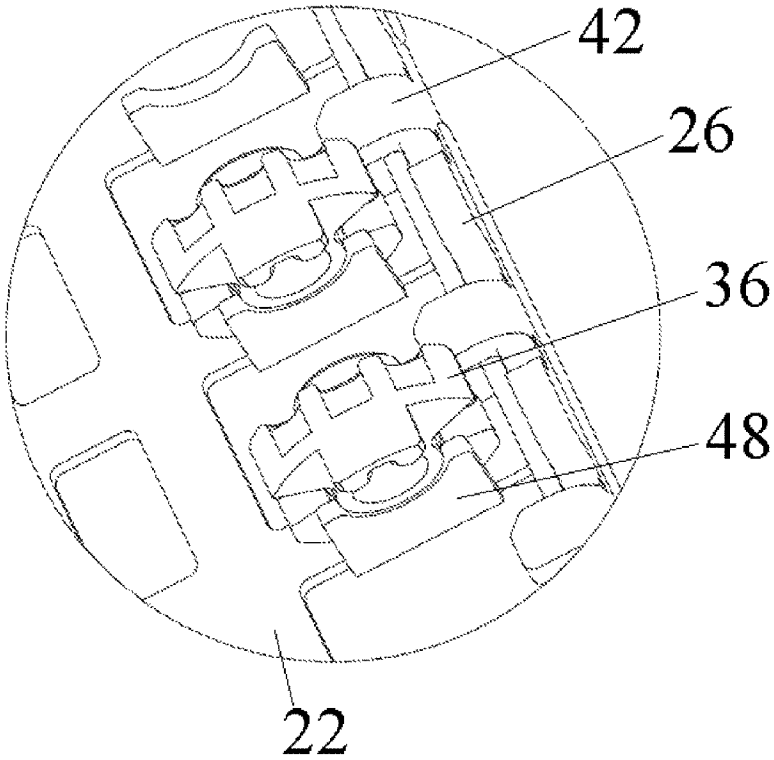
FIGS. 3*c* and 3*d* are enlarged schematic perspective illustrations of the locking apparatus of FIGS. 3*a* and 3*b* in a code unchangeable condition and a code changeable condition respectively.
Figure 3C:
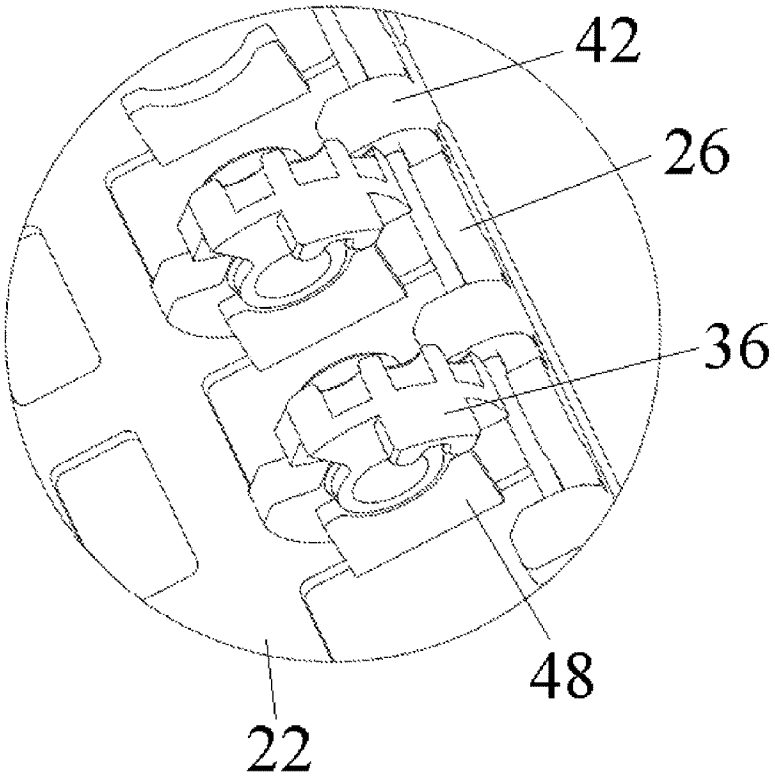

As best illustrated in the enlarged views in FIGS. 3*c* and 3*d*, the second control plate 22 may be formed with a series of tabs 48 engaging respectively with the series of coding disc clutch plates 36 mounted on the central axle 34 of each locking tumbler 18, 20. When the code change button 19 is pressed after the selected group of the buttons 14, which correspond to the access code, have been pressed, the angled slide 32 urges the second control plate 22 to make a translational movement relative to the base 15, resulting in that the series of coding disc clutch plates 36 are dislocated from the series of button engagement disc clutch plates 38 by the series of tabs 48, thereby allowing a user to change the access code by selecting and pressing another group of the buttons 14, and changing angular orientation of the button engagement disc clutch plates 38 relative to their corresponding coding disc clutch plates 36.

The locking apparatus of the present application has the advantage of allowing the access code of the locking tumbler to be quickly and easily changed by a user without requiring the locking apparatus to be removed or dismantled.

It is understood that resilient means may be provided within the body of the apparatus in order to resiliently bias components of the apparatus in the open, closed, engaged or disengaged configurations. The resilient means may include coiled springs or any other appropriate means.

Figure 4:
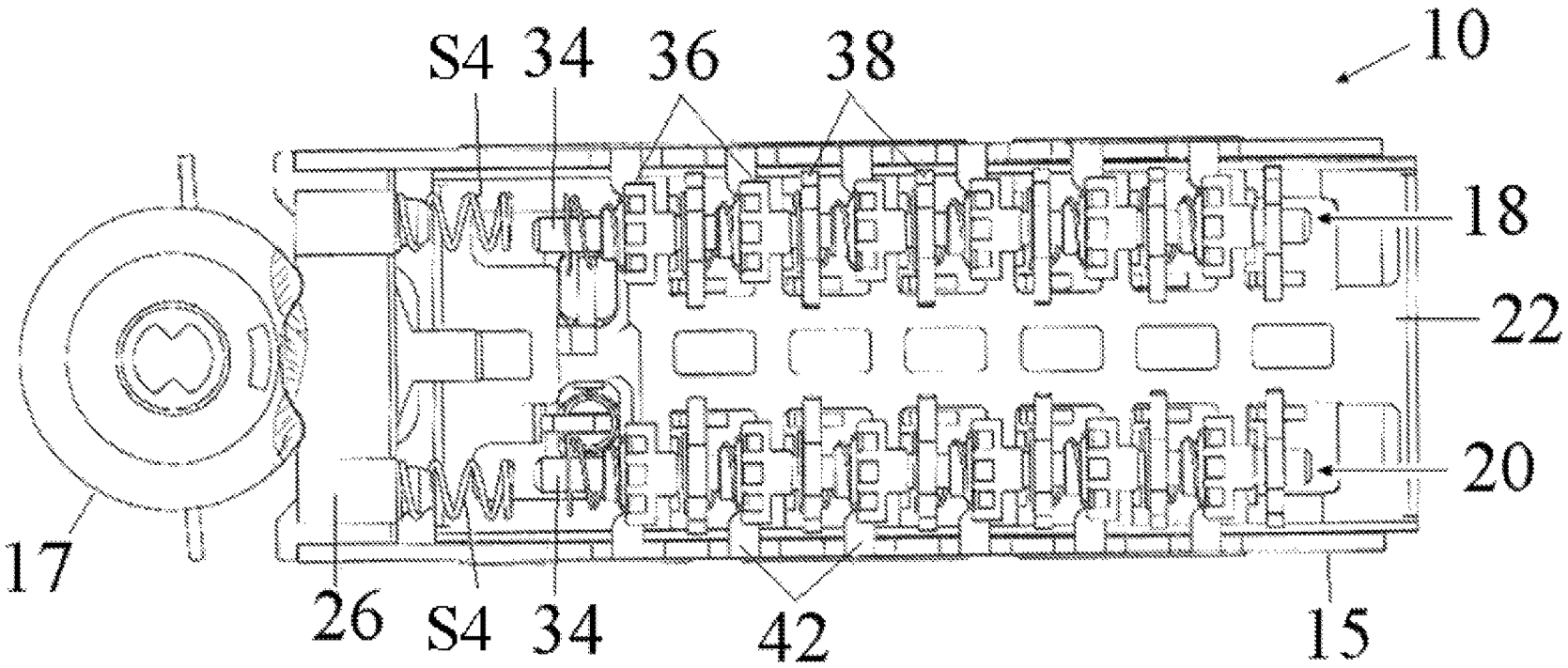
FIG. 4 is a schematic bottom plan view illustration of the locking apparatus in a code change mode where the coding tumbler clutch plates and button engagement clutch plates have been translated out of engagement with one another.

When the coding disc clutch plates 36 translate to the left of FIG. 3 or FIG. 4, the button engagement disc clutch plates 38 do not move since they are held in position by the button pins 28. Each button pin 28 is returned to its original position by the action of primary and secondary springs S1 and S2 (FIG. 8).

Figure 9:
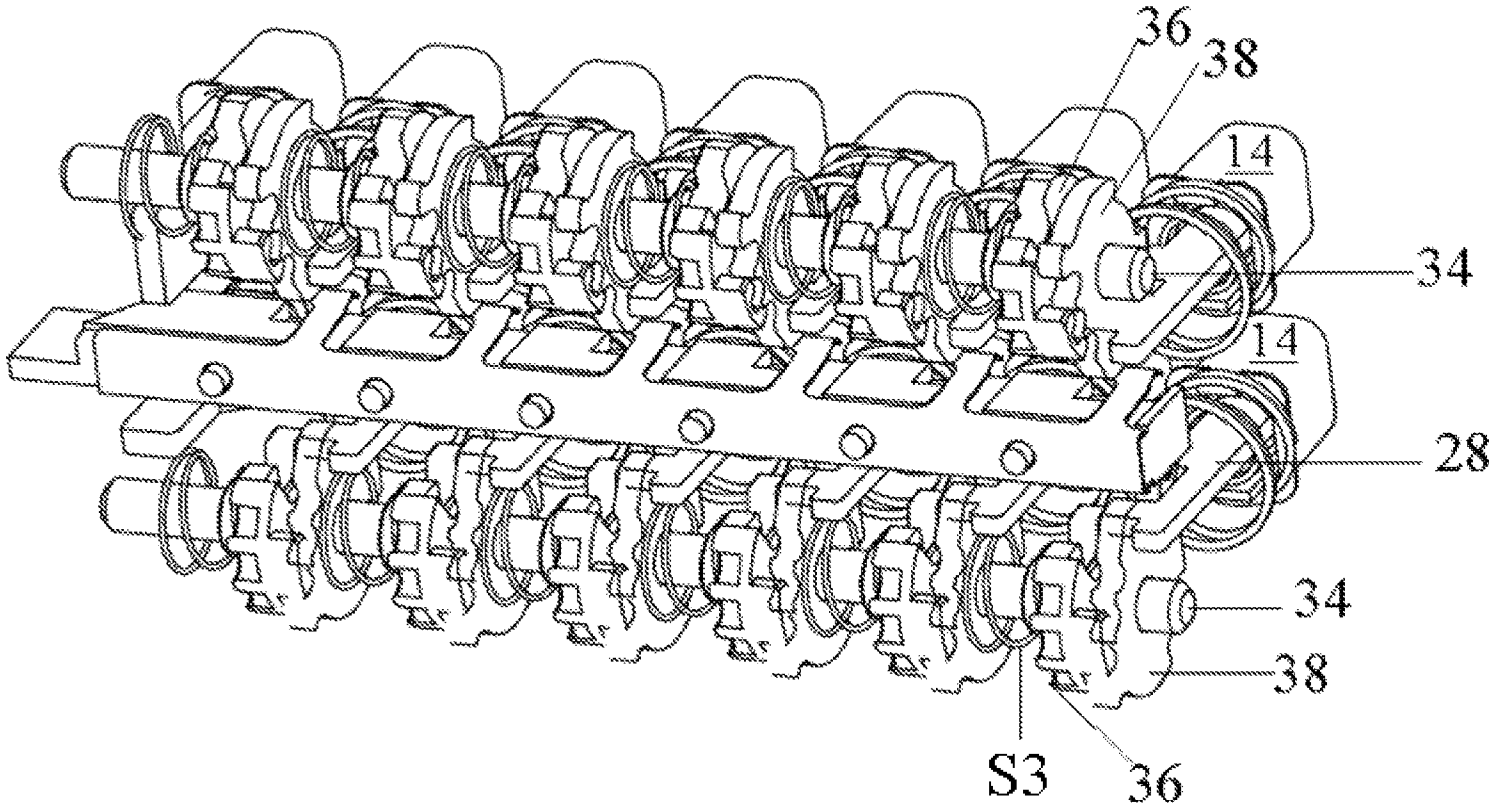
FIG. 9 is an underside schematic perspective illustration of the arrangement of FIG. 8.

Once a new code is entered into the apparatus, the apparatus is then returned to its normal operating mode by the action of tertiary springs S3 (FIG. 9).

When the correct access code has been pressed, the tabs 42 are allowed to move freely between the coding disc clutch plates 36 through the cut-out apertures 37. The coding disc clutch plates 36 are allowed to be moved by their corresponding tabs 48, thereby dislocating the coding disc clutch plates 36 from the button engagement disc clutch plates 38, and allowing angular orientation of the coding disc clutch plates 36 (coded or non-coded) to be changed.

A pair of quaternary springs S4 (FIG. 4) can be provided on the first control plate 26 for biasing the first control plate 26 towards the actuating hub 17.

Figure 10B:
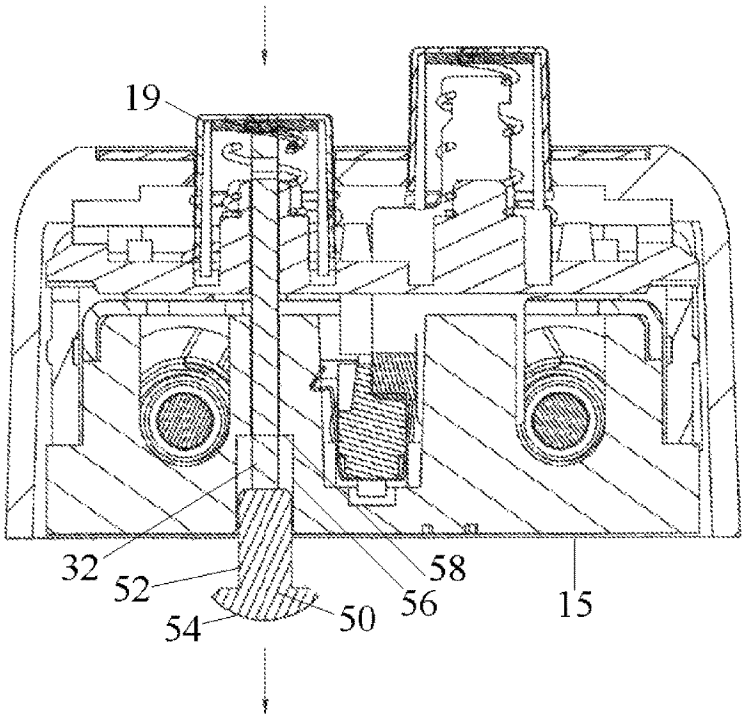
FIG. 10*b* is an end view of the coding tumblers where the locking block is being pushed out by the angled slide of the code change button.
Figure 10A:
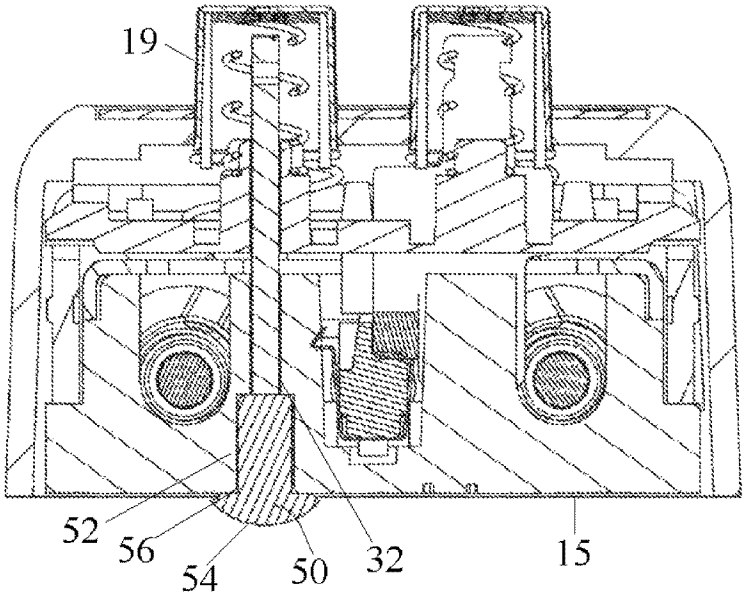
FIG. 10*a* is an end view of the coding tumblers where the interaction between a locking block and an angled slide of a code change button is illustrated.

With reference to FIGS. 10*a* and 10*b*, a locking block 50 may be provided at the base 15 of the apparatus. The locking block 50 may have a block body 52 formed with an enlarged head 54. The block body 52 can be inserted into a bore 56 formed at the base 15. An inner end of the block body 52 can abut against an inner end of the angled slide 32 of the code change button 19, and an outer end of the block body 52 can be provided with the enlarged head 54 located on an outer surface of the base, as depicted in FIG. 10*a*.

The locking block 50 can be held in place within the bore 56 when the base 15 of the locking apparatus 10 is held against and secured on any access panel, such as a door panel (not shown). The locking block 50 can drop out of the bore 56 after the locking apparatus 10 is detached from the panel, and the inner end of the angled slide 32 is inserted into the bore 56 through an opening 58 by pressing the code change button 19, as illustrated by the arrows in FIG. 10*b*.

The previous access code may be cancelled by pressing a reset button 60, as shown in FIGS. 1 and 1*a*, which can bring all angular orientations in line with one another in preparation for selection of a new access code. In the present embodiment, the reset button 60 may be provided next to the code change button 19.

Figure 11B:
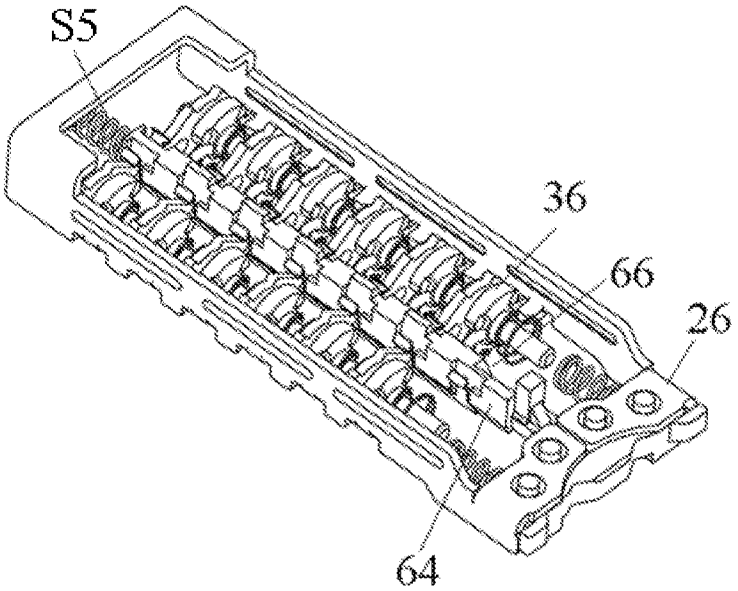
FIG. 11*b* is a schematic perspective illustration of the locking apparatus showing the coding bar returned to its original position after release of the reset button.
Figure 11A:
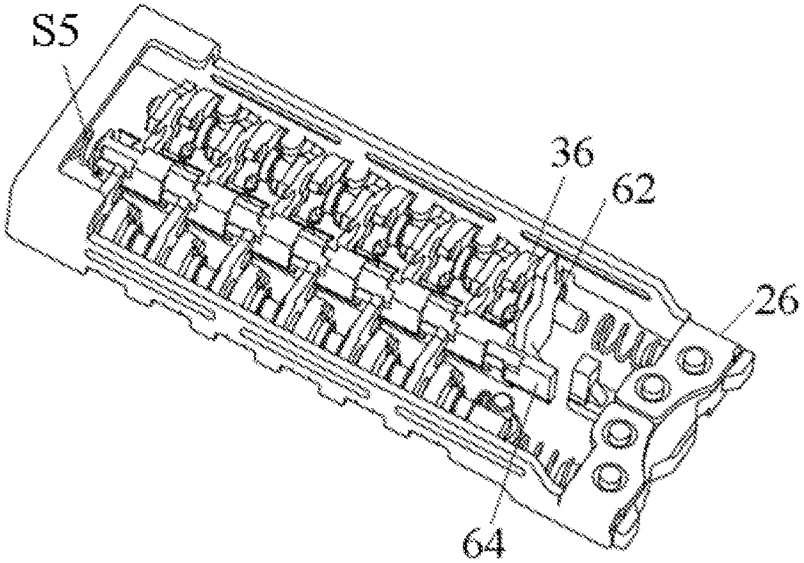
FIG. 11*a* is a schematic perspective illustration of the locking apparatus showing a reset slide of a reset button urging a spring-biased coding bar in one direction.

As shown in FIGS. 11*a* and 11*b*, in addition to the reset button 60, the locking apparatus may also include a reset slide 62 provided underneath the reset button 60. A coding bar 64 may be mounted on the base 15 between the first and second locking tumblers 18, 20. The coding bar 64 may be formed with a sloped surface 66 facing the reset slide 62. A quinary spring S5 may be mounted between one end of the coding bar 64 and the base 15 for biasing the coding bar 64 in one direction.

When the selected group of the buttons 14 are pressed, their respective coding disc clutch plates 36 rotate and engage with the coding bar 64, and when the reset button 60 is pressed, the reset slide 62 presses on the sloped surface 66 and urges the coding bar 64 to move in an opposite direction against the biasing force of the quinary spring S5, thereby releasing the coding disc clutch plates 36 to their initial positions. When the reset button 60 is released, the coding bar 64 returns to its initial position under the influence of the quinary spring S5.

The above described embodiments of the locking apparatus of the present application provide a coded locking apparatus on which the code may be easily changed by a user that is able to enter the correct existing access code. The locking apparatus of the present application achieves this without requiring any dismantling or dismounting of the apparatus.

Although particular embodiments of the locking apparatus of the present application have been disclosed herein in detail, this has been done by way of example and for the purposes of illustration only. The aforementioned embodiments are not intended to be limiting with respect to the scope of protection defined in the present application.

It is contemplated by a person skilled in the art that various substitutions, alterations, and modifications may be made to the locking apparatus of the present application without departing from the spirit and scope of protection as defined by the appended claims.

What is claimed is:

1. A locking apparatus comprising:

(a) a cover plate coupled with a base;

(b) a plurality of buttons provided on a cover plate;

(c) an actuating hub rotatably mounted on the base, a circumference of the actuating hub formed with a recessed portion defining two projections;

(d) a grip handle connected with the actuating hub;

(e) a first control plate disposed adjacent to the actuating hub and having one end formed with a raised portion, the two projections of the actuating hub being abutted against two sides of the raised portion of the first control plate respectively, such that when the actuating hub rotates clockwise or anticlockwise, one of the two projections presses against a corresponding one of the two sides of the raised portion of the first control plate, the first control plate further comprising two longitudinal side plates, and a plurality of teeth projecting inwardly from each of the two longitudinal side plates;

(f) first and second parallel locking tumblers, each comprising a central axle mounted on the base;

(g) a series of button engagement disc clutch plates mounted on the central axle of each locking tumbler, each button engagement disc clutch plate comprising a pair of button pin engagement levers for engagement therein between with a protruded portion of a button pin of the button; and (h) a series of coding disc clutch plates mounted on the central axle of each locking tumbler, and engaging respectively with the series of button engagement disc clutch plates, each coding disc clutch plate comprising a cut-out aperture;

(i) whereby pressing a selected group of the buttons, which correspond to an access code, rotates their respective button engagement disc clutch plates and in turn their respective coding disc clutch plates such that the cut-out apertures align with the teeth of the first control plate, thereby allowing movement of the first control plate and rotation of the actuating hub when the grip handle is rotated.

2. A locking apparatus comprising:

(a) a plurality of buttons provided on a cover plate which is coupled with a base;

(b) an actuating hub rotatably mounted on the base, a circumference of the actuating hub formed with a recessed portion defining two projections;

(c) a grip handle connected with the actuating hub;

(d) a first control plate disposed adjacent to the actuating hub and having one end formed with a raised portion, the two projections of the actuating hub being abutted against two sides of the raised portion of the first control plate respectively, such that when the actuating hub rotates clockwise or anticlockwise, one of the two projections presses against a corresponding one of the two sides of the raised portion of the first control plate, the first control plate further comprising two longitudinal side plates, and a plurality of teeth projecting inwardly from at least one of the two longitudinal side plates;

(e) at least one locking tumbler, the or each locking tumbler comprising a central axle mounted on the base;

(f) a series of button engagement disc clutch plates mounted on the central axle of the or each locking tumbler, each button engagement disc clutch plate comprising a pair of button pin engagement levers for engagement therein between with a protruded portion of a button pin of the button; and (g) a series of coding disc clutch plates mounted on the central axle of the or each locking tumbler, and engaging respectively with the series of button engagement disc clutch plates, each coding disc clutch plate comprising a cut-out aperture;

(h) whereby pressing a selected group of the buttons, which correspond to an access code, rotates their respective button engagement disc clutch plates and in turn their respective coding disc clutch plates such that the cut-out apertures align with the teeth of the first control plate, thereby allowing movement of the first control plate and rotation of the actuating hub when the grip handle is rotated.

3. The locking apparatus as claimed in claim 2, comprising a pair of parallel locking tumblers, and the plurality of teeth projecting inwardly from each of the two longitudinal side plates of the first control plate.

4. The locking apparatus as claimed in claim 3, further comprising a code change button, and an angled slide provided underneath the code change button, the angled slide being formed with a slanted surface which engages with an inner edge of a second control plate.

5. The locking apparatus as claimed in claim 4, wherein the second control plate comprises a series of tabs engaging respectively with the series of coding disc clutch plates on the central axle of each locking tumbler;

whereby when the code change button is pressed after the selected group of the buttons have been pressed, the angled slide urges the second control plate to make a translational movement relative to the base, resulting in that the series of coding disc clutch plates dislocate from the series of button engagement disc clutch plates by the series of tabs, thereby allowing a user to change the access code by selecting and pressing another group of the buttons, and changing angular orientation of the button engagement disc clutch plates relative to their corresponding coding disc clutch plates.

6. The locking apparatus as claimed in claim 5, wherein each button engagement disc clutch plate comprises three recessed portions formed along a peripheral portion thereof, and each coding disc clutch plate comprises two projected portions formed along a peripheral portion thereof;

wherein when the two projected portions are engaged with two of the three recessed portions, the cut-out aperture of the coding disc clutch plate is aligned with the teeth of the first control plate, and when the two projected portions are engaged with another two of the three recessed portions, the cut-out aperture of the coding disc clutch plate is out of alignment with the teeth of the first control plate.

7. The locking apparatus as claimed in claim 3, wherein a primary spring and a secondary spring are provided around the button pin of each button to resiliently return the button to its original position after having been pressed and released by the user.

8. The locking apparatus as claimed in claim 3, wherein a tertiary spring is provided between adjacent sets of engaging button engagement disc clutch plate and coding disc clutch plate on each central axle for biasing each coding disc clutch plate against its engaging button engagement disc clutch plate.

9. The locking apparatus as claimed in claim 3, wherein a pair of quaternary springs is provided on the first control plate for biasing the first control plate towards the actuating hub.

10. The locking apparatus as claimed in claim 3, wherein the base is provided with a locking block comprising a block body with an enlarged head, the block body being inserted into a bore formed at the base, such that an inner end of the block body abuts against an inner end of the angled slide of the code change button, and an outer end of the block body is provided with the enlarged head located on an outer surface of the base;

wherein the locking block is held in place within the bore when the base of the locking apparatus is held against and secured on a panel, and the locking block drops out of the bore after the locking apparatus is detached from the panel, and the inner end of the angled slide is inserted into the bore through an opening by pressing the code change button.

11. The locking apparatus as claimed in claim 3, further comprising a reset button; a reset slide provided underneath the reset button; a coding bar mounted on the base between the first and second locking tumblers and formed with a sloped surface facing the reset slide; and a quinary spring mounted between one end of the coding bar and the base for biasing the coding bar in one direction;

wherein when the selected group of the buttons are pressed, their respective coding disc clutch plates rotate and engage with the coding bar, and when the reset button is pressed, the reset slide presses on the sloped surface and urges the coding bar to move in an opposite direction against biasing force of the quinary spring, thereby releasing the coding disc clutch plates to their initial positions, and when the reset button is released, the coding bar returns to its initial position.

12. The locking apparatus as claimed in claim 3, wherein the protruded portion of each button pin protrudes perpendicularly from the button pin of the button.

13. The locking apparatus as claimed in claim 3, wherein the pair of button pin engagement levers projects in a direction radially outwardly from the central axle.

14. The locking apparatus as claimed in claim 3, wherein the selected group of the buttons comprises one or more of the buttons provided on the cover plate.

* * * * *